US006615011B2

(12) United States Patent
Yoshikawa

(10) Patent No.: US 6,615,011 B2
(45) Date of Patent: Sep. 2, 2003

(54) ELECTROPHOTOGRAPHIC IMAGE PRINTING APPARATUS USING LIQUID DEVELOPER

(75) Inventor: Norio Yoshikawa, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/950,660

(22) Filed: Sep. 13, 2001

(65) Prior Publication Data

US 2002/0031373 A1 Mar. 14, 2002

(30) Foreign Application Priority Data

Sep. 13, 2000 (JP) ..... 2000-278500

(51) Int. Cl.[7] ..... G03G 15/10
(52) U.S. Cl. ..... 399/250; 399/249
(58) Field of Search ..... 399/92, 93, 98, 399/249, 250, 251, 348

(56) References Cited

U.S. PATENT DOCUMENTS 4,259,006 A 3/1981 Phillips et al.
5,737,674 A * 4/1998 Venkatesan et al. ..... 399/250
5,905,928 A * 5/1999 Shin ..... 399/250
5,937,249 A * 8/1999 Shin ..... 399/249
6,064,851 A * 5/2000 Saitoh ..... 399/249 X
6,085,055 A * 7/2000 Shin et al. ..... 399/250
6,141,518 A * 10/2000 Shin et al. ..... 399/250
6,314,260 B1 * 11/2001 Watanabe ..... 399/250

FOREIGN PATENT DOCUMENTS

JP 2862432 11/1993

* cited by examiner

*Primary Examiner*—Sandra Brase
(74) *Attorney, Agent, or Firm*—Oblon, Spivak, McClelland, Maier & Neustadt, P.C.

(57) ABSTRACT

Disclosed is an electrophotographic printing apparatus for printing an image on a print medium with use of a liquid developer which contains a liquid carrier and a toner being dispersed in the liquid carrier. It has an image printing system having a circulative imaging surface on which a toner image is formed from the liquid developer, and transferring the toner image from the circulative imaging surface to the print medium: A collection member which is capable of absorbing or adsorbing vapor of the liquid carrier is provided to be disposed in a place which is surrounded by the circulative imaging surface, and a vapor directing system directs air containing the vapor of the liquid carrier vaporizing from the imaging surface, to the collection member.

19 Claims, 14 Drawing Sheets

ELECTROPHOTOGRAPHIC IMAGE PRINTING APPARATUS USING LIQUID DEVELOPER

BACKGROUND OF THE INVENTION

1. Field of the Invention

The present invention relates to an electrophotographic image printing apparatus for forming an image using a liquid developer by an electrophotographic technology. More particularly, the present invention relates to an electrophotographic printing apparatus equipped with an exhaust treating apparatus for treating an exhaust containing a vapor of a carrier solvent generated in an apparatus by use of a liquid developer.

2. Related Art

From the standpoint of the developers used, electrophotographic technologies are classified into those of dry development using a solid developer and those of liquid (wet) development using a liquid developer. In the conventional electrophotographic technologies, wet development is believed to be practically disadvantageous because of some substantial problems, and consequently, the field of image formation by electrophotographic technologies has been long occupied substantially by dry development.

However, electrophotography of wet development has also an advantage which can not be realized by dry development. Examples include that: since an extremely fine toner of sub-micron size can be used, high image quality can be realized; since sufficient image concentration is obtained with a small amount of toner, an economical advantage is obtained and texture corresponding to offset printing or other like printing can be realized; since a toner can be fixed to paper at relatively lower temperature, energy saving and high speed output can be realized; and the like. Based on these facts, the value of electrophotography based on wet development has been reviewed and development is in progress aiming at practical use.

Substantial problems of an electrophotographic technology based on wet development are concerned with vaporization of an organic solvent which is contained as a carrier in a developer and treatments thereof, and one of them is that an exhaust containing the vaporized organic solvent must be necessarily subjected to treatment for removal of the organic solvent, before discharging the exhaust out of the printing apparatus. This problem is regarded recently as important from the standpoints of environmental pollution and health. Moreover, even in use of safe petroleum-based synthetic solvents exhibiting no carcinogenicity (Isoper manufactured by Exxson Chemical Japan LTD., and the like) as a carrier, other problems such as uncomfortable odor of a solvent occur. Therefore, it is desirable that a solvent in the exhaust is removed before discharge as completely as possible.

In order to solve this problem, for example, Japanese Patent No. 2892643 and U.S. Pat. No. 5,737,674 disclose electrophotography systems in which an exhaust containing a solvent vapor is liquefied and removed, and the concentration of vaporized solvent in the exhaust in U.S. Pat. No. 5,737,674 is lowered by passing the exhaust through a cooling liquid to cool and condense the vapor of solvent.

However, in the case of removing the vaporized solvent from the exhaust by the above system, liquefaction does not progress sufficiently if the contact area of cooling liquid with the exhaust is small and the contact time thereof is short. Therefore, the apparatus should be so constituted, for assured removal of a solvent, that the contact area and the contact time with the exhaust are sufficiently secured. Thus, a certain volume is necessary. Moreover, measures for controlling the treating conditions such as temperature and the like are also required to be installed. Therefore, the whole dimension of an image printing apparatus has to be increased.

It is not only in the above method of the liquefaction mode but also in general methods that securing the contact area with an exhaust is necessary for assured removal of a vaporized solvent from the exhaust, and it is important for size reduction of an image printing apparatus to constitute the apparatus so as to realize sure purification of an exhaust in a space that is as small as possible.

SUMMARY OF THE INVENTION

An object of the present invention is to provide an electrophotographic printing apparatus equipped with an exhaust cleaning device which is advantageous for size reduction of the whole apparatus and has long life.

Moreover, another object of the present invention is to provide an electrophotographic printing apparatus equipped with an exhaust cleaning device which can manifest efficient purification function sufficiently and can purify an exhaust assuredly.

Still another object of the present invention is to provide an electrophotographic printing apparatus having an exhaust cleaning device which provides easy works of removal and change, and which can be made into a cartridge.

In order to achieve the above objects, an electrophotographic printing apparatus for printing an image on a print medium with use of a liquid developer which contains a liquid carrier and a toner being dispersed in the liquid carrier, according to an aspect of the present invention, comprises: an image printing system comprising a circulative imaging surface for forming a toner image from the liquid developer, and transferring the toner image from the circulative imaging surface to the print medium; a collection member which is capable of absorbing or adsorbing vapor of the liquid carriers the collection member being disposed in a place which is surrounded by the circulative imaging surface; and a vapor directing system which directs air containing the vapor of the liquid carrier vaporizing from the imaging surface to the collection member.

BRIEF DESCRIPTION OF THE SEVERAL VIEWS OF THE DRAWINGS

The features and advantages of the electrophotographic printing apparatus according to the present invention over the proposed apparatus will be more clearly understood from the following description of the preferred embodiments of the present invention taken in conjunction with the accompanying drawings in which like reference numerals designate the same or similar elements or sections throughout the figures thereof and in which.

DETAILED DESCRIPTION OF THE INVENTION

Image formation by electrophotography using a liquid developer is attained by the steps of: generating an electrostatic latent image on a photosensitive layer by effecting light exposure, corresponding to an image to be formed, on the surface of a charged photosensitive layer and eliminating charge on the exposed part; developing the electrostatic latent image with a toner by feeding on the surface of the photosensitive layer a liquid developer which is prepared by dispersing a toner having electrostatic charge in a carrier composed of insulating liquid (organic solvent), namely, a developing solution; removing an unnecessary liquid carrier; and transferring the developed image to a print medium (recording medium such as paper, etc.) from the photosensitive layer. In the case of a multicolor electrophotography, all of these steps are repeated on each of four colors, yellow (Y), magenta (M), cyan (C) and black (Bk), or generation of an electrostatic latent image, development and removal of an unnecessary carrier are conducted on each color to form full color images on a photosensitive layer, then a transfer step is conducted.

Treatment of an exhaust containing the vapor of the solvent which is contained in a developer as a carrier necessitates a space on a certain scale. As a cleaning method for removing the solvent from the exhaust, a cooling condensation method as described above and an adsorption (or absorption) method using a massive filter or a column filled with an adsorbent (or absorber) are envisaged, and the solvent removed from the exhaust can be recovered and used again in any of the methods. However, the cooling condensation method necessitates to provide a cooling system and adopt the heat as a measure for vaporizing the solvent, in order to enable cooling condensation. In view of the above requirement, the adsorption method is more advantageous for reduction of the treatment space, as compared with the cooling condensation method. However, in the adsorption (absorption) method, the effective period of a filter is restricted to a time until an adsorbent is saturated with the solvent. Therefore, if the size of the filter is reduced, the maximum treatment volume decreases, leading directly to making the life of the filter short.

From the above matters, in an electrophotographic printing apparatus of the present invention, the cleaning device is so constructed that an adsorption (or absorption) mode filter is disposed in a place which is surrounded by the photosensitive layer in an image formation system based on electrophotographic printing. Embodiments of the electrophotographic printing apparatus of the present invention and an exhaust cleaning device thereof will be described in detail below, referring to drawings. In the following descriptions, the same or equivalent members and parts are designated by the same marks, and repeated detailed explanations will be omitted, regarding they have the same action.

Figure 1:
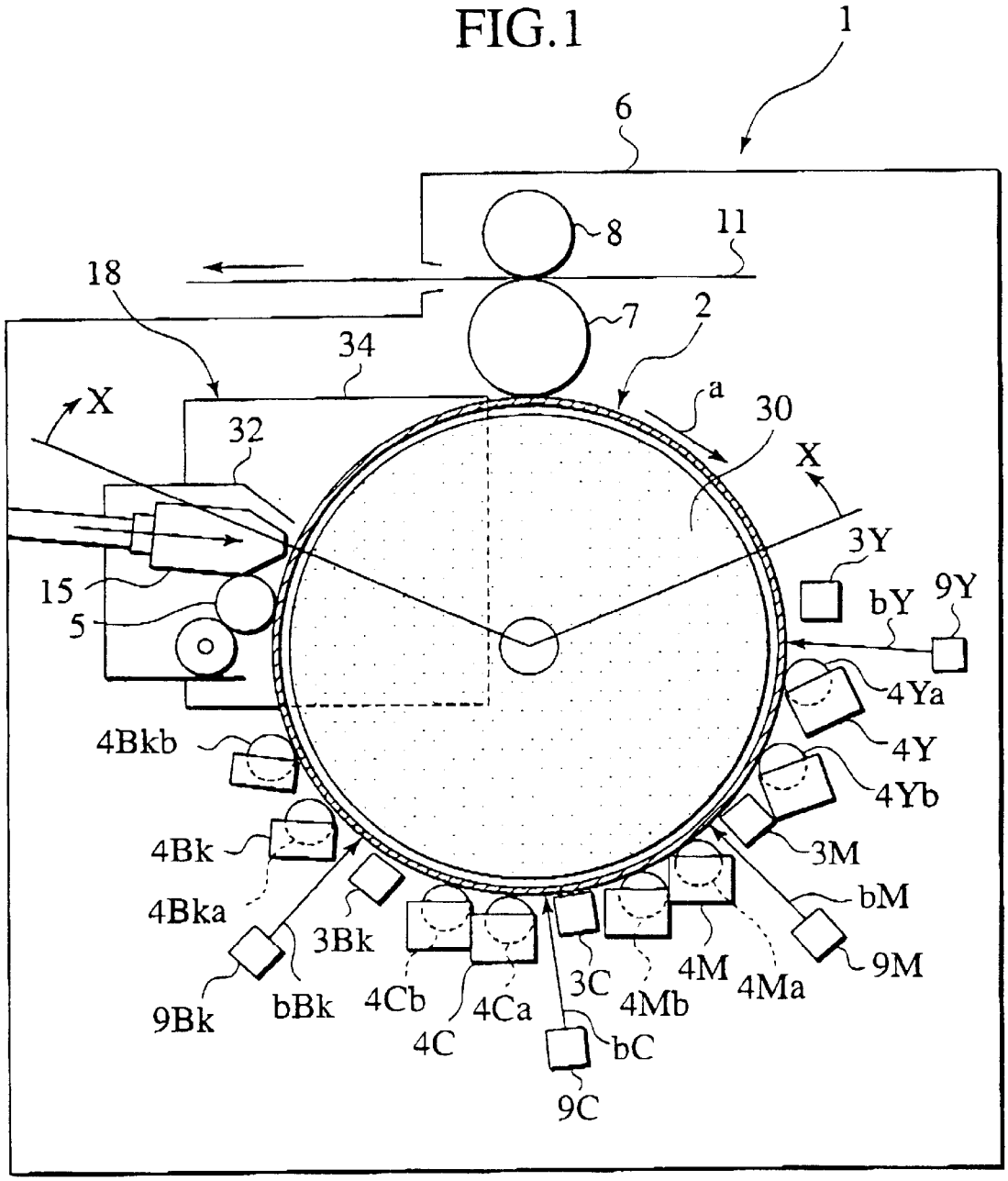
FIG. 1 is a schematic constitutional view showing one embodiment of an electrophotographic printing apparatus of the present invention.
Figure 2:
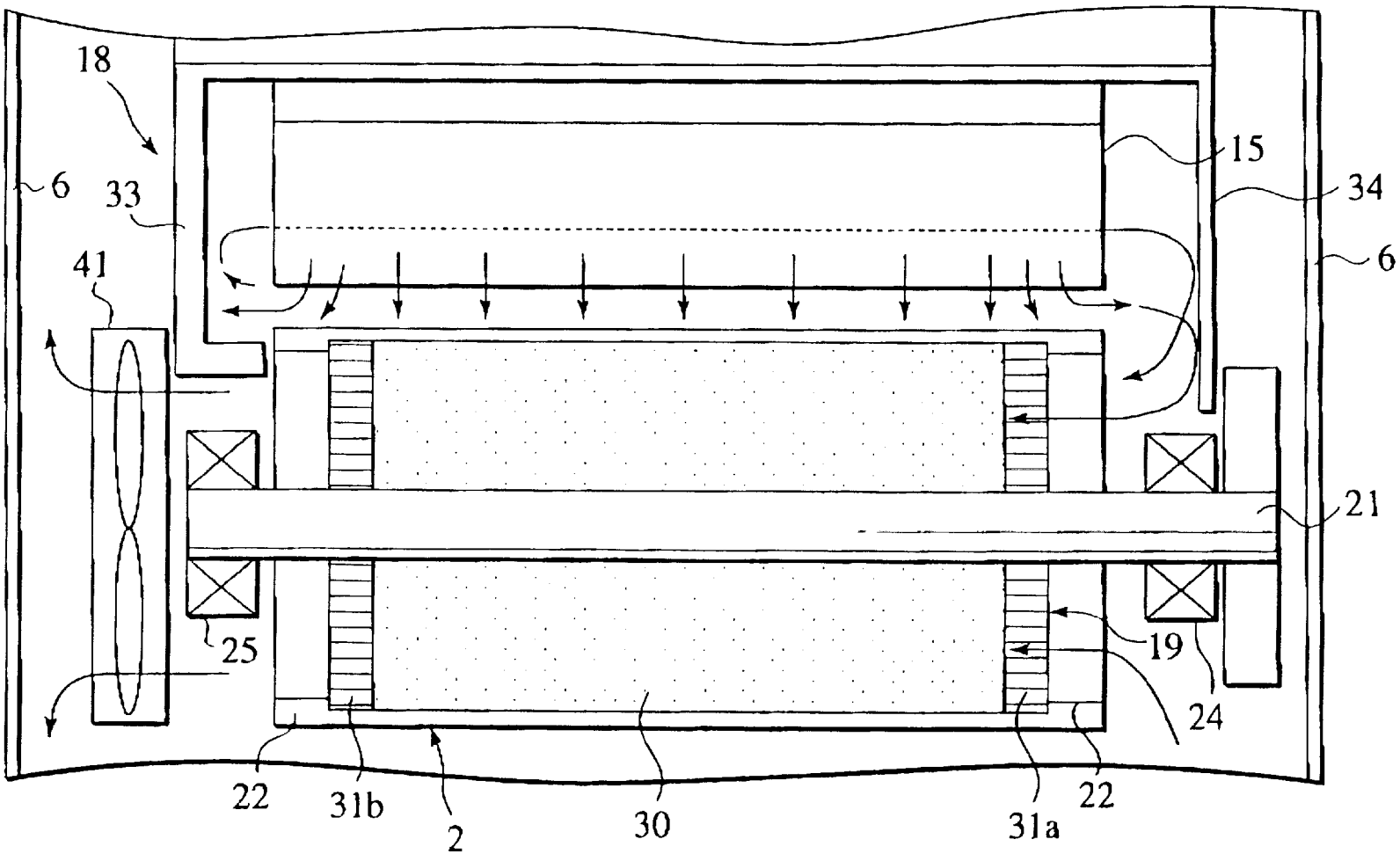
FIG. 2 is a cross-sectional view of the electrophotographic printing apparatus taken along a line X—X in FIG. 1.

FIG. 1 is a sectional view showing schematic construction of the first embodiment of an electrophotographic printing apparatus according to the present invention. FIG. 2 is a cross-sectional view of the electrophotographic printing apparatus taken along in the line X—X in FIG. 1. The electrophotographic printing apparatus 1 is constructed so that a multicolored image is formed on the circumferential surface of a tubular photosensitive body 2 for providing and maintaining an latent image, which is then transferred to a print medium. The photosensitive body 2 is produced by providing on the periphery of a tubular conductive substrate a photosensitive layer for generating an electrostatic latent image, the photosensitive layer being constituted of an organic photosensitive material or an amorphous silicon photosensitive material. Around the periphery of the photosensitive body 2, electrostatic chargers 3Y, 3M, 3C and 3Bk; developer units 4Y, 4M, 4C and 4Bk with squeezes 4Yb, 4Mb, 4Cb and 4Bkb positioned subsequent to the above electrostatic chargers 3Y, 3M, 3C and 3Bk, respectively, along the rotational direction of the photosensitive body 2; an effluent solvent removing roller 5 positioned subsequent to the above developer units; and an intermediate transfer roller 7 circumscribed to the photosensitive body 2 are placed. Moreover, a press roller 8 pressed in contact via a print medium 11 with the intermediate transfer roller 7, and a housing 6 covering these members are provided on the apparatus. The developer units 4Y, 4M, 4C and 4Bk are provided with developing rollers 4Ya, 4Ma, 4Ca and 4Bka, respectively, and liquid developers of respective colors are fed by them. The squeezes 4Yb, 4Mb, 4Cb and 4Bkb are in the form of a roller, and the developing rollers and squeezes are so placed as to form a slight clearance between the photosensitive body 2 and them, respectively. A blow nozzle 15 for drying is placed subsequent to the above effluent solvent removing roller 5. Air is supplied to the blow nozzle 15 through a piping from out of the apparatus and blown toward a part of the peripheral surface of the photosensitive body in a straight line parallel to the axial direction of the photosensitive body 2. Exposure apparatuses 9Y, 9M, 9C and 9Bk are provided for directing laser or LED to photosensitive layers subsequent to the electrostatic chargers 3Y, 3M, 3C and 3Bk respectively.

When the photosensitive body 2 is rotated clock-wise as shown by an arrow a in the drawing, the photosensitive layer on the surface of the photosensitive body 2 is charged uniformly by the electrification charger 3Y according to the mode or corona charging, scorotron charging and the like, irradiation corresponding to a yellow image against a charged photosensitive layer is effected from the exposure apparatus 9Y along the direction of an arrow bY, to form an electrostatic latent image for the yellow image. Further, by rotation of the developing roller 4Ya of the developer unit 4Y to the reverse direction to the rotation direction of the photosensitive body 2, the liquid developer of yellow color is fed to the photosensitive layer, and the charged yellow toner particles are transported to any one of the electrostatic latent image part and non-latent image part by electrophoresis and developed, to form a yellow image. The squeeze 4Yb is rotated to the same rotational direction as that of the photosensitive body 2 (the surfaces thereof move against to each other), and a lipophilic surface of the squeeze 4Yb removes most of unnecessary liquid carrier from the surface of the photosensitive body.

Also, for magenta, cyan and black images, the same operations as described above are repeated by using by the electrostatic chargers 3M, 3C and 3Bk, the exposure apparatuses 9M, 9C and 9Bk, the developing rollers 4Ma, 4Ca and 4Bka and the squeezes 4Yb, 4Cb and 4Bkb, and electrostatic latent Images generated by irradiation In the radial directions shown by arrows bM, bC and bBk are developed. A solvent remaining on the full color images formed is removed by squeezing with use of the effluent solvent removing roller 5 with pressed to the photosensitive body 2, and a solvent still remaining is vaporized by air fed from the blow nozzle 15. A toner image on the surface of the photosensitive body 2 is transferred to the intermediate transfer roller 7 having higher surface tackiness than that of the photosensitive body 2. This image is heated by the intermediate transfer roller 7, transferred to a print medium by the press roller 8, thereby one cycle of the circulation of photosensitive layer is completed. With continuation of the circulation of photosensitive layer, the image formation and the transfer are repeated. The print medium 11 is transported from right to left along the direction of an arrow d in the drawing, and printed before carrying to a paper tray (not shown). It is also possible to transfer the toner image on the photosensitive body 2 directly to the recording medium 11 without interposing the intermediate transfer roller 7. However, the transfer using the intermediate transfer roller 7 is preferable from the standpoint of the precision of printed images by offset force and heat. In this case, it is necessary to almost completely evaporate the liquid carrier or the solvent of the toner image before transfer. For this purpose, a drying mechanism using both the effluent solvent removing roller 5 and the blow nozzle 15 together is effective. Most of the carrier solvent is recovered in the form of liquid by the effluent solvent removing roller 5, and a small amount of carrier solvent contained in the toner image is vaporized by the blow nozzle 15.

In the electrophotographic printing apparatus 1, an exhaust cleaning device 19 for removing a vapor of the carrier solvent from the exhaust is provided on the inner bore of the tubular photosensitive body 2, and the exhaust containing carrier vapor evaporated from the developed toner images is fed to the exhaust cleaning device 19 by an air draft system 18.

The exhaust cleaning device 19, as shown in FIG. 2, is composed of: a collection member 30 which is mounted on the inner bore part of the photosensitive body 2 supported by bearings 24 and 25 and rotated by a driving shaft 21; and a pair of permeable members 31*a* and 31*b* in the form of a disk placed on the both axial ends of the photosensitive body 2, and it is supported on the inner bore part by a flanges 22 provided on the both ends of the photosensitive body 2. The flange 22 can give support so that the exhaust cleaning device 19 is not released from the photosensitive body, and it can be formed into any form, providing that the outer space of the photosensitive body 2 communicates with the exhaust cleaning device 19 inside the photosensitive body.

A collection member 30 includes an adsorbable or absorbable material which is constructed by using an adsorbent which can adsorb the solvent such as charcoal, metal oxide and the like or an absorber which can absorb a solvent such as a porous material, a fibrous material and the like. If charcoal, for example, is used, the material can be prepared into, for example, a particulate charcoal or a filling material powder containing this, a massive filter of charcoal particles that is made by molding into porous structure such as honeycomb structure and the like by sintering or use of a binder, a massive filter in which charcoal particles are fixedly carried on a ceramic material, and the like. If the collection member 30 in the form of a massive filter is adhered and fixed to the inner bore of the photosensitive body 2, an effect of enhancing the internal strength of the photosensitive body 2 is caused, and such structure is advantageous from the standpoints of: weight reduction of the photosensitive body 2 formed of a raw material such as an aluminum alloy or stainless material and the like: lowering of noise thereof; and increase in image quality owing to lowering of vibration. The material which constitutes the permeable members 31*a* and 31*b* may be in any form such as net, slit, sponge and the like, providing that a material which can provide ventilation is used. If the member is also formed of a material which can absorb and hold the carrier liquid, it is capable of controlling functional failure which is caused by the dew of the carrier solvent formed in the photosensitive body 2, because, even when a carrier vapor forms dew in the photosensitive body 2, it is held by the permeable member.

The air draft system 18 has guide covers 32, 33 and 34 equipped on the blow nozzle 15, and a fan 41 placed near one end of the photosensitive body 2 for generating an air flow. The guide cover 32 is extended in such a manner that it approximates and covers the blow nozzle 15 and the tip end thereof is in parallel to the axis of the photosensitive body 2 while keeping a slight clearance between the tip end and the peripheral surface of the photosensitive body 2. In accordance with this structure, the air blown to the photosensitive body 2 from the blow nozzle 15 is inhibited from being diffused along the circumference of the photosensitive body 2. On the other hand, the guide cover 33 extends along a radial plane with respect to the photosensitive body 2 to cover one side of the blow nozzle 15, and the tip end of the guide cover 33 is bent to extend toward the edge of the peripheral surface in parallel to the axis of the photosensitive body 2. Therefore, the flow of air flowing from the blow nozzle 15 toward the guide cover 33 in parallel with the axis of the photosensitive body 2 is suppressed by the guide cover 33. Further, at the other side of the blow nozzle 15 opposing to the guide cover 33, the guide cover 34 extends along a radial plane with respect to the photosensitive body 2 so that it covers the other end at a predetermined distance, and the tip end thereof reaches near the bearing 24 which rotatably supports the photosensitive body 2. Accordingly, diffusion of the air from the blow nozzle 15 in parallel to the axial direction is suppressed. A fan 41 is placed coaxially with the photosensitive body 2 on the guide cover 33 side of the photosensitive body 2, and an air flow directing from the photosensitive body 2 to the fan is generated.

In accordance with the above construction, when air is blew from the blow nozzle 15 while driving the fan 41, the air gives generation of a carrier vapor from the toner images developed on the photosensitive body 2, and the vapor flows from the tip of the blow nozzle 15 toward the guide cover 34 and is directed by the guide cover 34 into the exhaust cleaning device 19 in the photosensitive body 2, passing through the collection member 30. The cleaned air is then exhausted by the fan 41 out of the guide cover 33.

Figure 3:
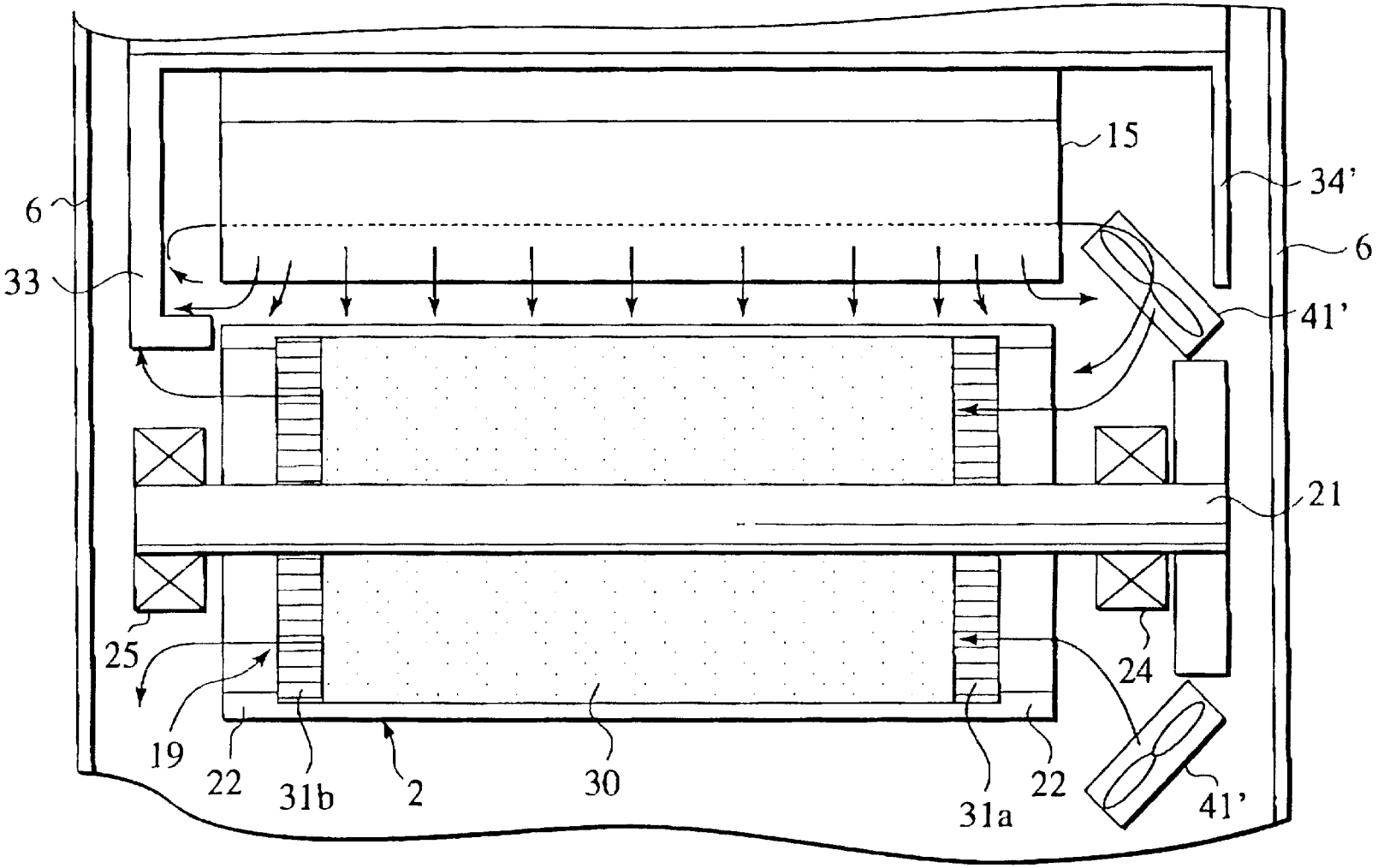
FIG. 3 is a sectional view showing the first modified example of the electrophotographic printing apparatus of FIG. 1.

In the embodiment of FIG. 2, the fan 41 for generating an air flow works for sucking air from the collection member 30, and it is still possible change the fan. For example, as shown in FIG. 3, at least one or more fans 41' may be placed on the opposite side to that of FIG. 2, so as to carry the air toward the collection member 30. In this case, it is advantageous to change the guide cover 34 of FIG. 2 to the guide cover 34' placing near the fan 41' in FIG. 3 so that the air flow from the blow nozzle 15 is fed to the fan 41'. Alternatively, fans may also be provided on both sides of the photosensitive body 2.

Figure 4:
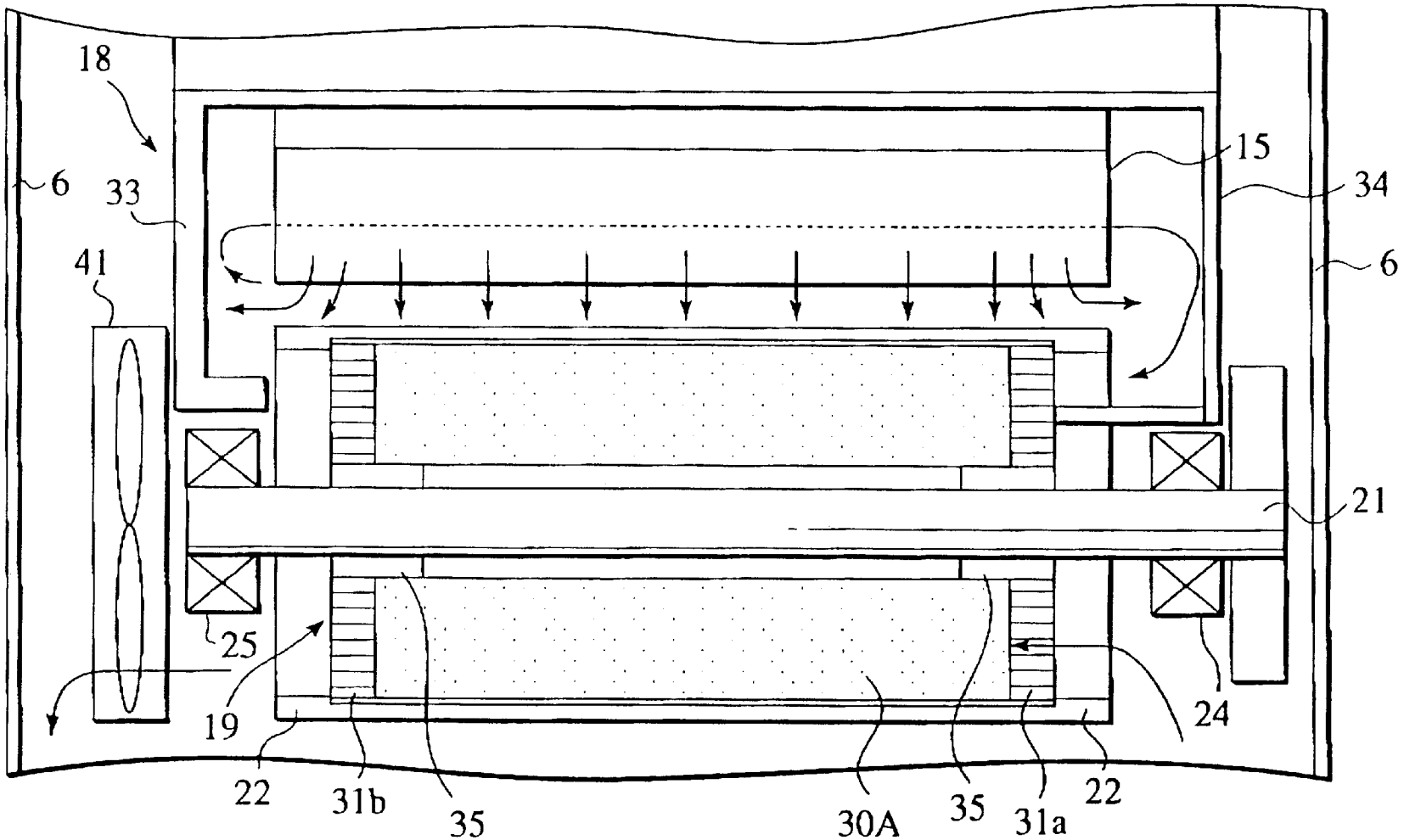
FIG. 4 is a sectional view showing the second modified example of the electrophotographic printing apparatus of FIG. 1.

FIG. 4 shows an example modified from the embodiment shown in FIGS. 1 and 2, and in this example, a collection member 30A in the form of a massive filter is used and mounted via a filter supporting bearing 35 so that the clearning member 30A does not synchronize with the rotation of the photosensitive body 2. For securing immobilization of the collection member 30A, the permeable member 31*a* is connected to the guide cover 34. This structure has also an effect of suppressing consumption power of the fan 41 since an air flow into the filter easily flows substantially perpendicularly to the surface of the permeable member 31*a* in this structure.

Figure 5:
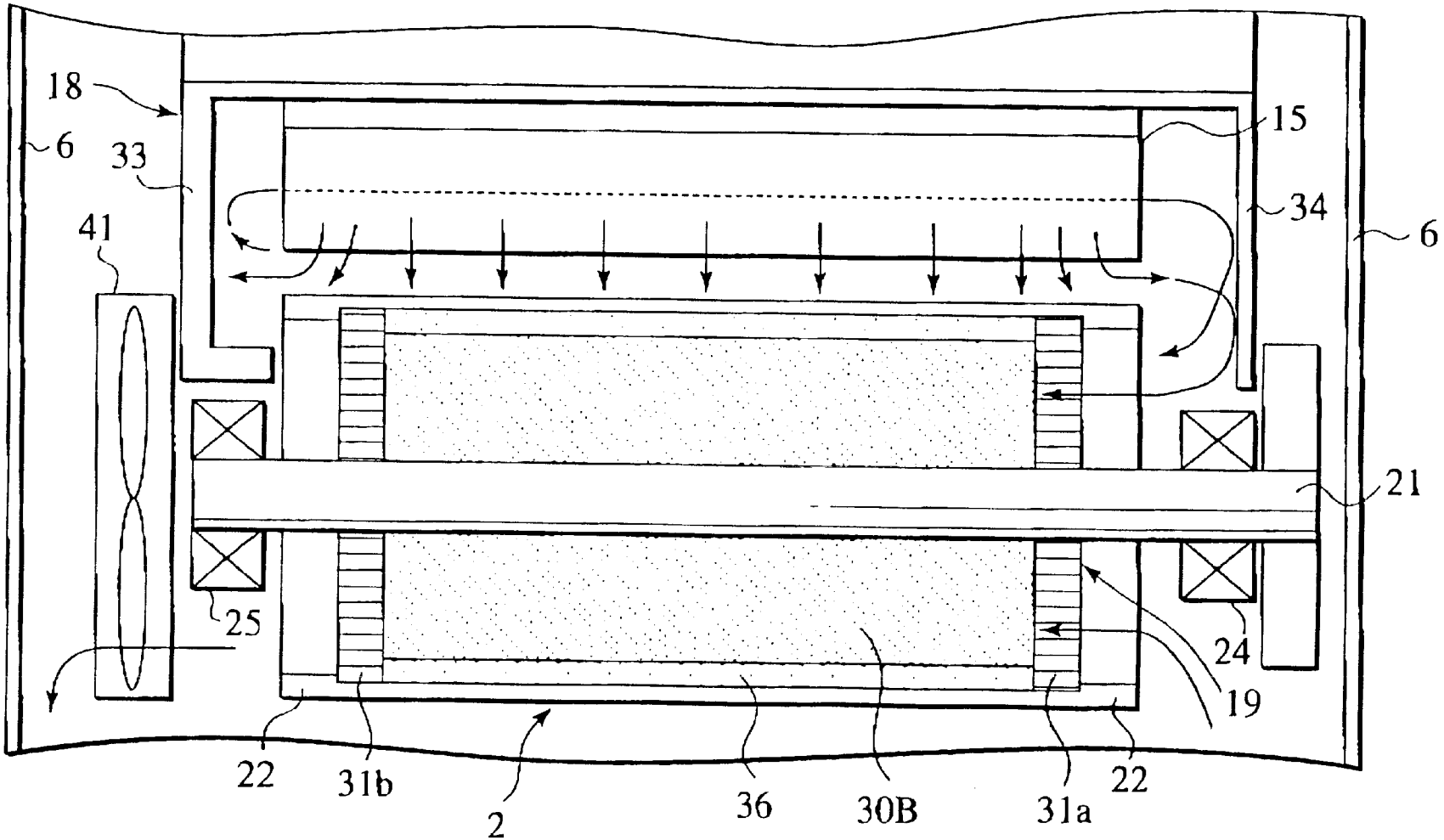
FIG. 5 is a sectional view showing the third Modified example of the electrophotographic printing apparatus of FIG. 1.

FIG. 5 shows a modified example of the embodiment shown in FIGS. 1 and 2 in which a collection member 30B is mounted on the inside of a cushioning member 36 placed along the wall surface of the inner bore part of the photosensitive body 2. In this case, if an adsorbent or absorber in a particulate form is used as the collection member 30B, noise occurring by movement of the particles of the collection member 30B with rotation of the photosensitive body 2 and noise due to an action between the particles and the photosensitive body 2 can be suppressed by the cushioning member 36 via which the collection member 30B is disposed in the photosensitive body 2. As the adsorbent in a particulate form, there are listed, for example, fractured charcoal or spherical fractured charcoal produced front coconut shell or coal-based materials, sulfonated spherical carbon material manufactured by Hokutan Chemical Industry Co., Ltd., Kureha spherical charcoal manufactured by Kureha Techno Eng Co., Ltd., and the like. If the member is formed of, for example, a porous material or a fiber material such as non-woven fabric and the like, the cushioning member 36 exhibits also an effect of absorbing the dew of the carrier solvent formed inside the photosensitive body as well as the silencing effect.

Figure 6:
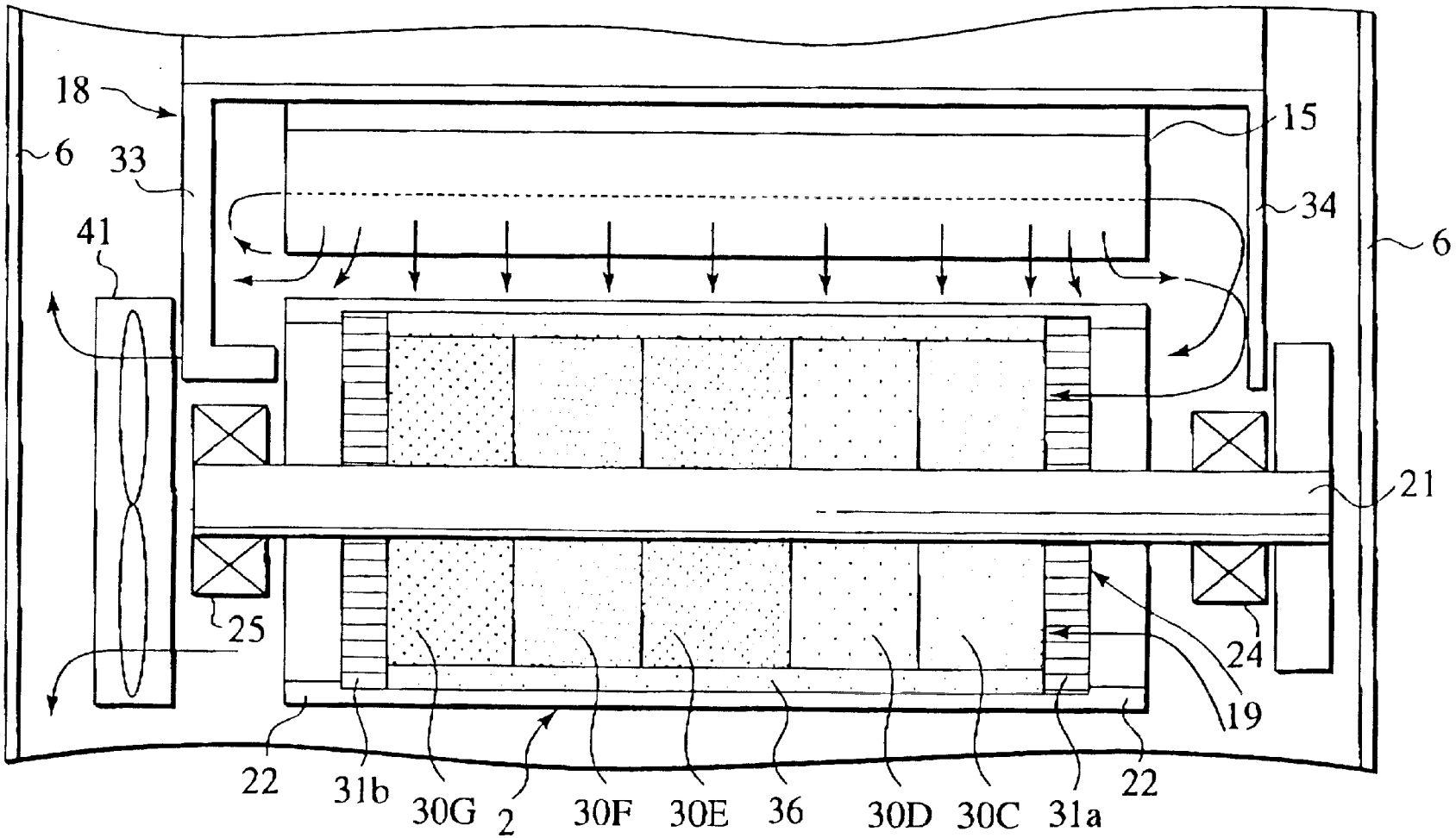
FIG. 6 is a sectional view showing the fourth modified example of the electrophotographic printing apparatus of FIG. 1.

FIG. 6 shows a modified example using a plurality of collection members 30C to 30G having different cleaning abilities on a carrier vapor in the embodiment of FIG. 5. The collection members 30C to 30G are placed in such a manner that, when an exhaust flows along the axial direction in the inner bore part of the photosensitive body 2, it passes through the collection members 30C to 30G sequentially. In this construction, the exhaust cleaning device can be improved to provide given treatment efficiency and life by placing the collection members in a suitable placing order in view of the solvent adsorbing (absorbing) property, adsorbing (absorbing) speed, surface area, pressure loss and the like of each collection member. If the collection members are in the form of a massive filter, they can be placed adjacent to one another in the inner bore part of the photosensitive body 2, and when the collection members are in a particulate form, they are filled sequentially via a permeable partition in the form of a disk for separating the collection members.

Figure 7:
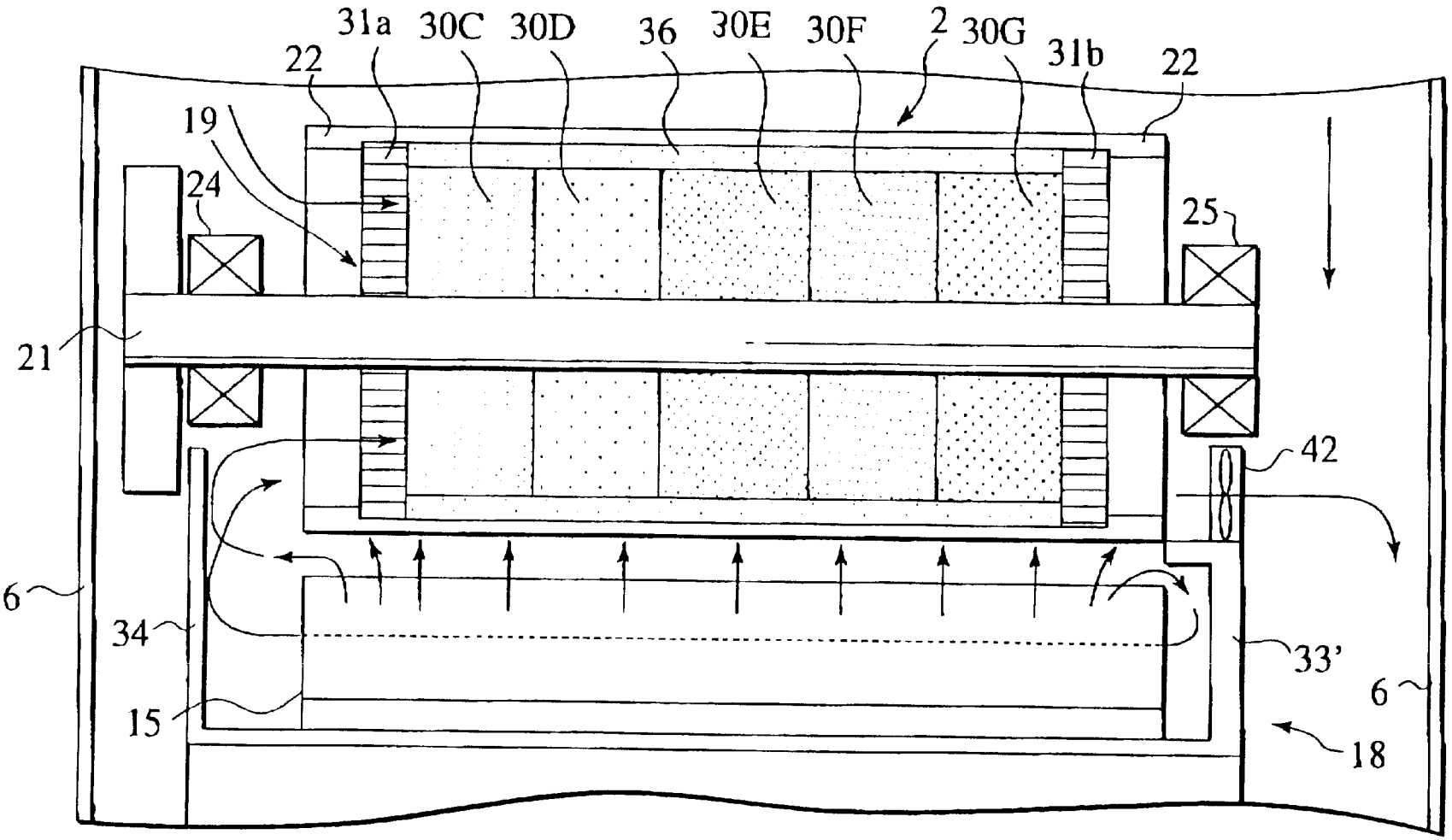
FIG. 7 is a sectional view showing the fifth modified example of the electrophotographic printing apparatus of FIG. 1.

FIG. 7 shows a modified example in which the inner bore part of the photosensitive body 2 is filled with an adsorbent in a particulate form as the collection member at a filling ratio of less than 100%. This example uses an adsorbent in a particulate form as the collection member 30F and 30G. In accordance with this construction, the adsorbent in a particulate form moves in the photosensitive body 2 by rotation of the photosensitive body and the part of particle which faces the flow of the exhaust changes among the whole surface of particle. Consequently, use ratio of adsorption ability can be enhanced, and adsorption efficiency and life can then be improved. In that case, a space is formed by the gravity at upper side of the adsorbent in a particulate form. Therefore, in order to secure passing of an exhaust through the adsorbent, a fan 42 for generating an air flow is placed at lower side than the driving shaft 21 so as to forcingly generate an air flow passing the adsorbent at the lower part. The guide covers 32, 33' and 34 also direct the exhaust flowing from the blow nozzle 15 to the adsorbent at the lower side. Since placing of the fan 42 needs a space, the length along the radial direction of the guide cover 33' in this example is reduced smaller than that of the guide cover 33 in FIG. 6. The adsorbent is filled at a volume ratio of about 70 to 80%, and it is preferable to use an adsorbent which has high friction resistance, strength and flowability and which causes no heat generation and no destruction by movement in a photosensitive body. For example, charcoal in a particulate form such as Kureha spherical charcoal manufactured by Kureha Techno Eng Co., Ltd., and the like are listed.

Figure 8:
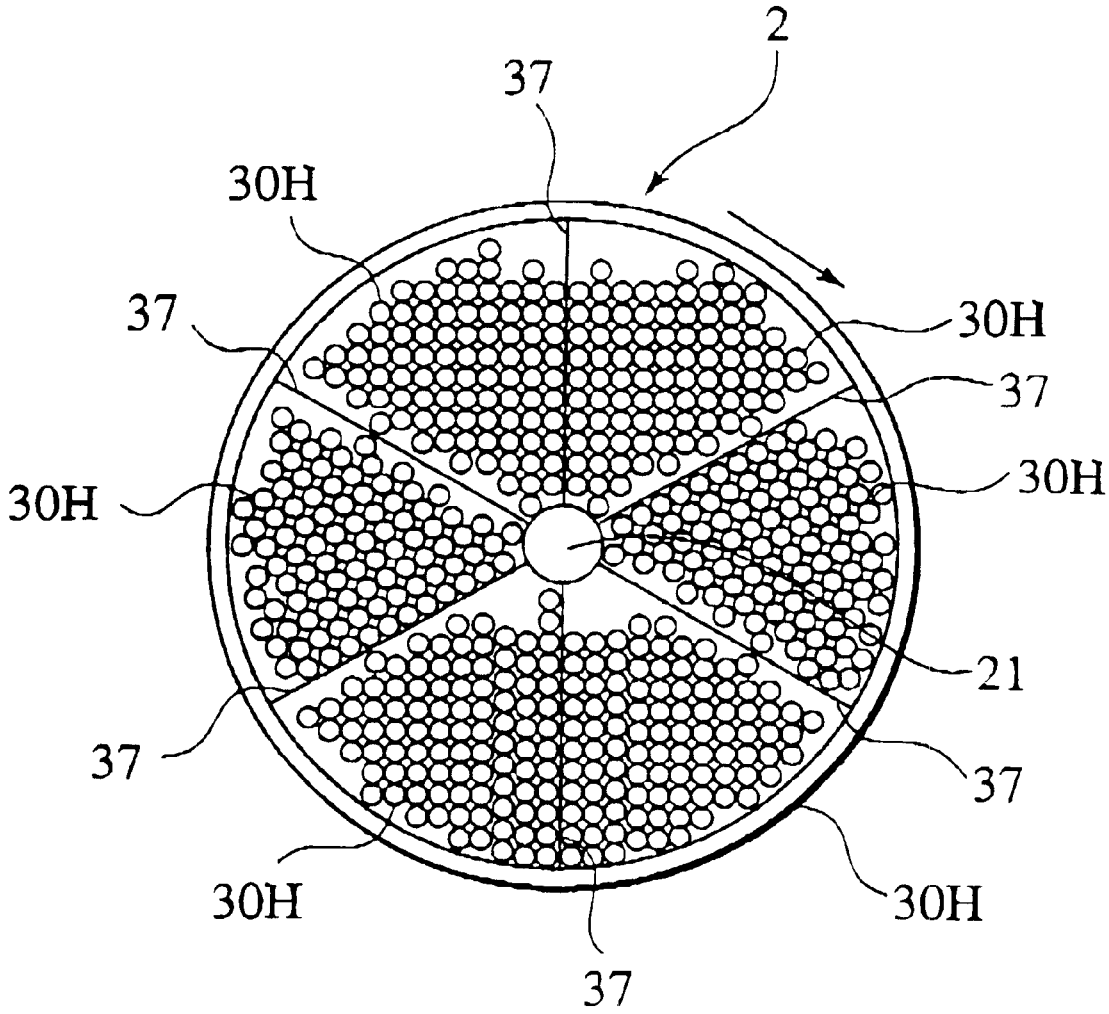
FIG. 8 is a sectional view taken along a radial direction of a photosensitive body showing the sixth modified example of the electrophotographic printing apparatus of FIG. 1.

FIG. 8 shows an example in which the inner bore part of the photosensitive body 2 filled with an adsorbent In a particulate form as the collection member 30H is divided and comparted into equivalent six portions by partition boards 37 placed along the radial direction in parallel to the driving axis 21. Also in this case, an effect owing to movement of an adsorbent is obtained as in the case of FIG. 7, however, for secure passing of an exhaust through the adsorbent, it is desirable to set the filling ratio of the adsorbent higher than that in the case of FIG. 7.

Figure 9:
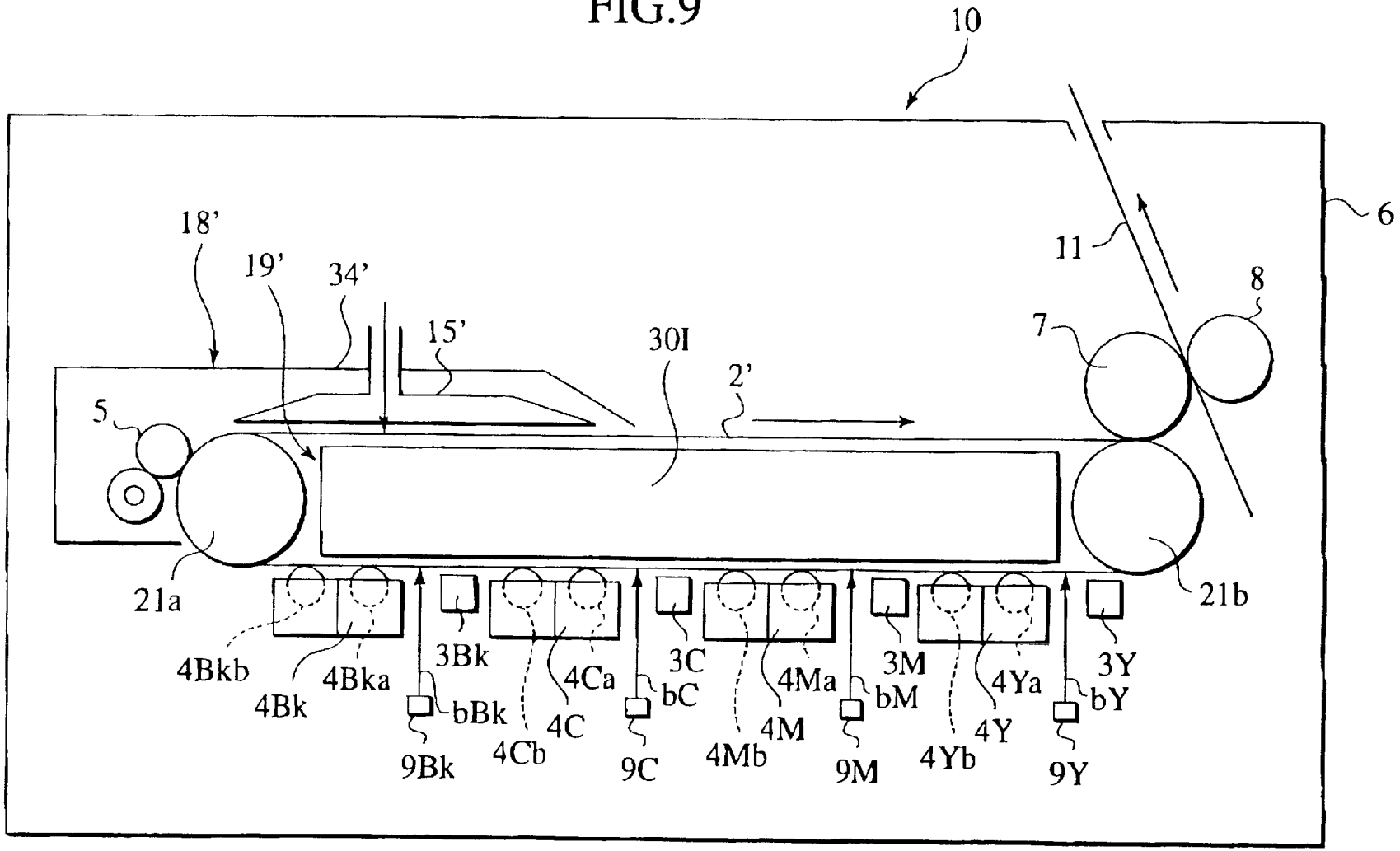
FIG. 9 is a schematic constitutional view showing the second embodiment of an electrophotographic printing apparatus of the present invention.

FIG. 9 shows an electrophotographic printing apparatus 10 in which a photosensitive body for holding a latent image is constituted of a circulating belt. The photosensitive body 2' in the form of a belt is operated by belt driving mechanisms 21*a* and 21*b*, and an exhaust cleaning device 19' is provided in the inner side space which is surrounded by photosensitive body 2' in the form of a belt, and an exhaust is purified by a collection member 301 formed of the same raw material as that of the collection member 30 described in the embodiment of FIG. 2. Differing from the case of a photosensitive body of a tubular drum type, the collection member 30I in the case of the photosensitive body 2' of a belt type is fixedly supported. As in the embodiment of FIG. 6, a plurality of collection members may also be used. For sufficient use of the treatment ability of the collection member, the form of the guide cover 34' of the air draft system 18' and the placement of a fan (not shown) are appropriately modified depending on the form of a blow nozzle 15' so that an exhaust is fed over the whole collection member. This type of image formation system has an advantage that constituent components such as developing apparatuses 4Y, 4M, 4C and 4Bk and the like can be placed horizontal on the positions at the same height.

Figure 10:
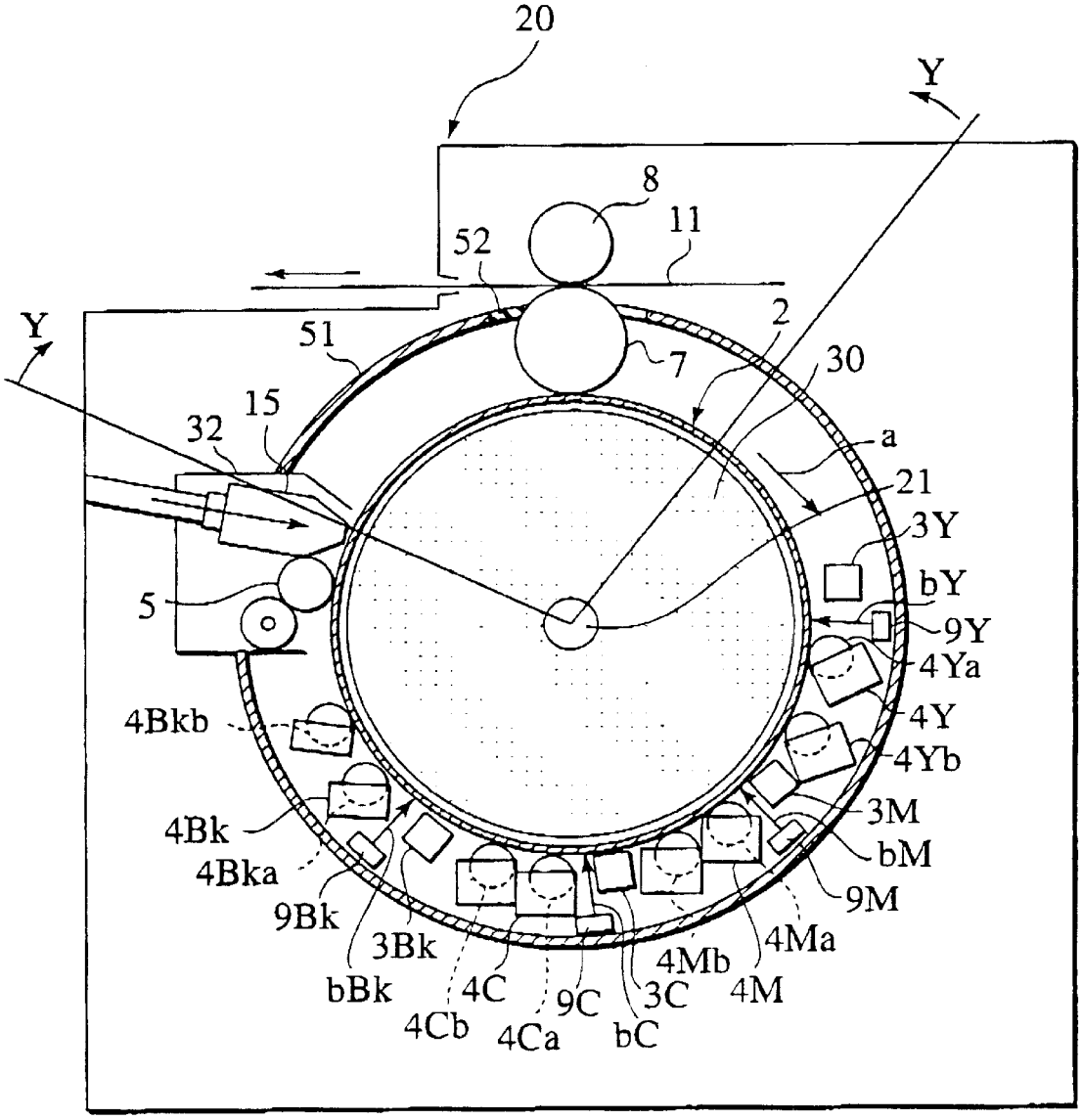
FIG. 10 is a schematic constitutional view showing the third embodiment of an electrophotographic printing apparatus of the present invention having a vessel for accommodating an image formation system.
Figure 11:
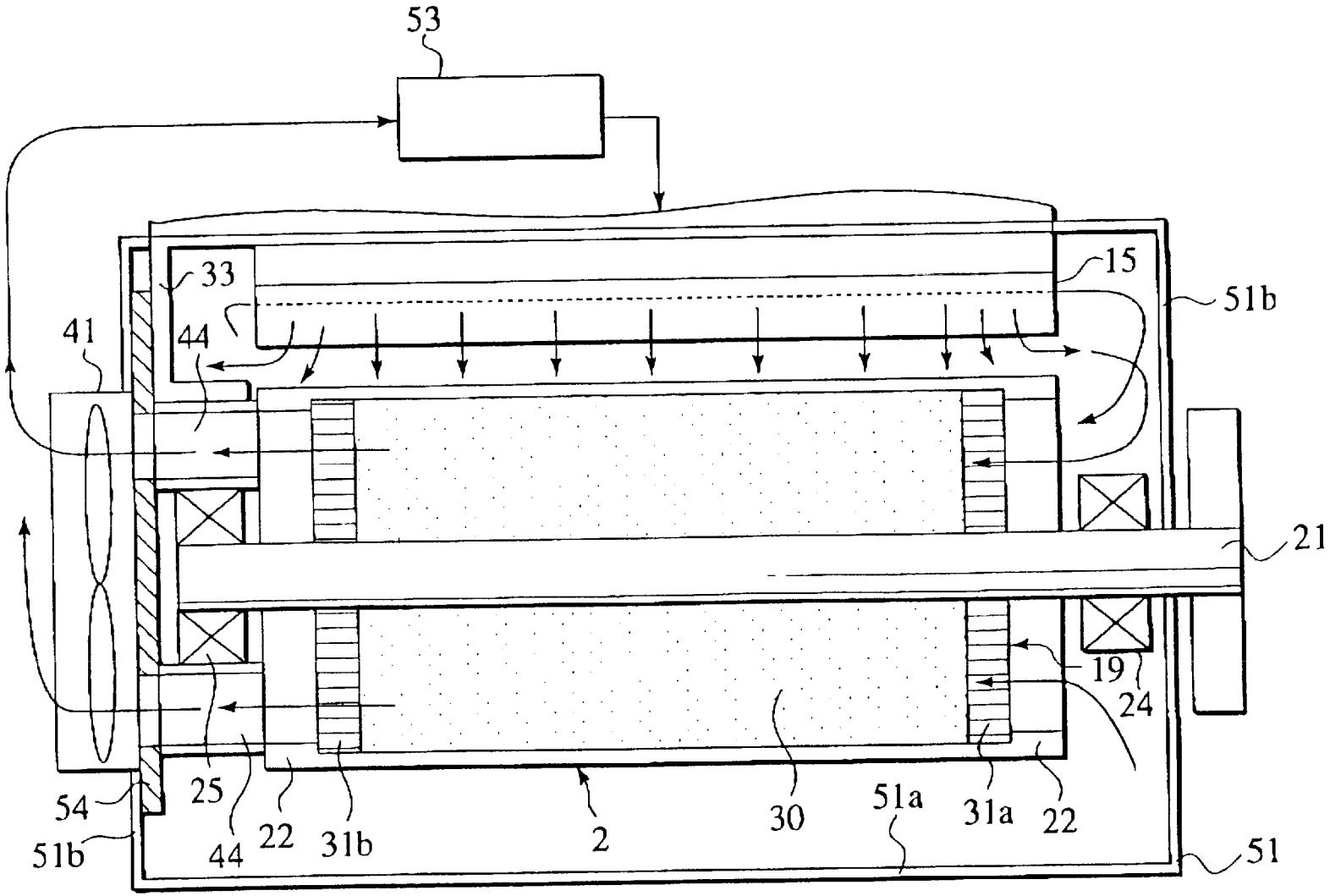
FIG. 11 is a cross-sectional view of the electrophotographic printing apparatus taken along a line Y—Y in FIG. 10.

FIGS. 10 and 11 show an electrophotographic printing apparatus 20 in which a vessel 51 for substantially accommodating an Image formation system is provided, for preventing diffusion of a solvent vaporized from developed images. As similar in the embodiment shown in FIGS. 1 and 2, a collection member 31 is fitted into the photosensitive body 2. The vessel 51 has a circumferential wall part 51*a* which surrounds the periphery of the photosensitive body 2 along the circumference and which is connected to a guide cover 32 of an air draft system, and a side wall part 51*b* covering the outer sides of both axial ends of the photosensitive body 2. The photosensitive body 2, developer units 4Y, 4M, 4C and 4Bk, squeezes 4Yb, 4Mb, 4Cb and 4Bkb, an effluent solvent removing roller 5 and a blow nozzle 15 are sealed substantially in a space comparted by the guide covers 32 and 33 and the vessel 51, and only a part of an intermediate transfer roller 7, that is used for transfer of a toner image to a recording medium, is positioned outside of the vessel 51. In this embodiment, a space between the intermediate transfer roller and the vessel 51 is provided at a position after transfer of an image and sealed by a sealing member 52, and a slight clearance is formed at a position before transfer. However, another construction is also permissible such that the intermediate transfer roller 7 and the press roller 8 are also accommodated in the vessel and a slit part through which a print medium 11 penetrates the vessel 51 is sealed when printing is not conducted. This construction is advantageous for making an image formation system into a cartridge, and by this cartridge, carrying easiness during replacing and fitting and the like for exchange of parts and repair is improved. Moreover, maintenance free can be realized.

In the above construction, a fan 53 for feeding air to the blow nozzle 15 can be provided on the outside of the vessel 51. An exhaust containing a vaporized carrier solvent generated on the surface of the photosensitive body 2 passes through the collection member 30 in the photosensitive body 2 along the air flow generated by the fan 41 and is resultantly cleaned, and it passes through a flow route 44 provided between the side wall part 51*b* of the vessel 51 and the flange 22 of the photosensitive body 2 and is then discharged out of the vessel 51. A seal member 54 is provided between the flow route 44 and the side wall 51*b* of the vessel, so that a carrier vapor not passing through the cleaning filter does not leak out of the vessel. The exhaust discharged out of the vessel 51 is transported again to the blow nozzle 15, by a fan 53 for generating an air flow, which is used in a drying mechanism placed outside of the vessel 51. A flow route through which air is returned to the blow nozzle 15 is blocked by a blocking plate (not shown) when a cartridge is removed from the apparatus, so that a carrier solvent is nor diffused. By such a constitution, a vapor of the carrier solvent generated in the vessel 51 is almost completely removed by the collection member in the vessel, and a solvent vapor having high concentration does not leak out of the system. Moreover, even when the cartridge containing the image formation system is removed, a carrier vapor generated in the vessel 51 can be removed by the collection member 31. Moreover, by preventing diffusion of a vaporized solvent, it is possible to improve treatment ability of the collection member and decrease the volume ratio of the collection member relative to the volume of the apparatus, with giving a compact cartridge.

Figure 12:
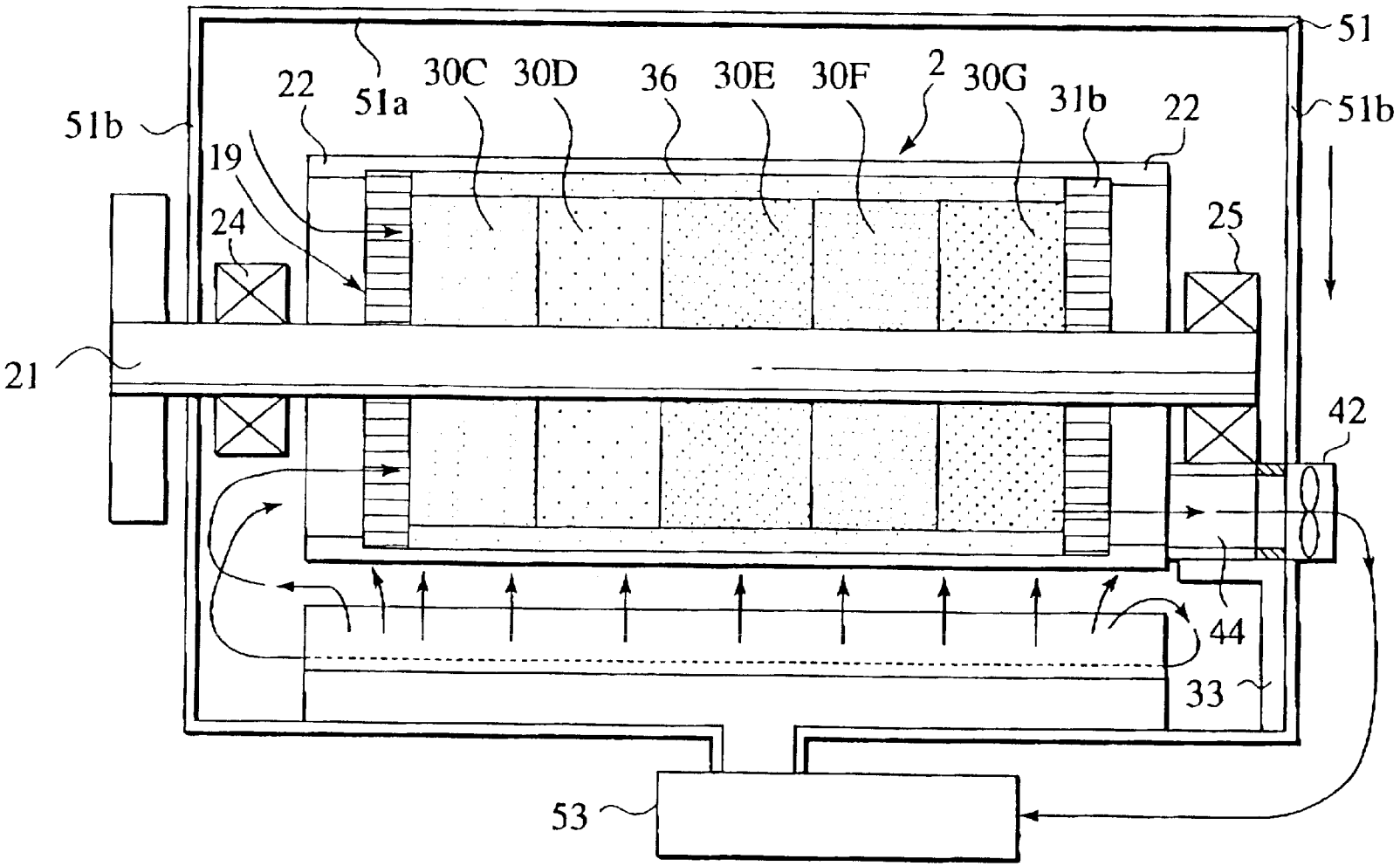
FIG. 12 is a sectional view showing one modified example of the electrophotographic printing apparatus of FIG. 10.

FIG. 12 shows an example obtained by modifying the embodiment shown in FIGS. 10 and 11, in which a plurality of collection members 30C, 30D, 30E, 30F and 30G are provided as shown in FIG. 7 and an adsorbent in a particulate form is used in some collection members 30F and 30G. Therefore, a flow route 44 of an exhaust out of a vessel 51 and a fan 42 are placed at the lower side to the gravity direction. Since a carrier solvent vapor used is heavier than air, it is effective to place the fan 42 at the lower side.

Figure 13:
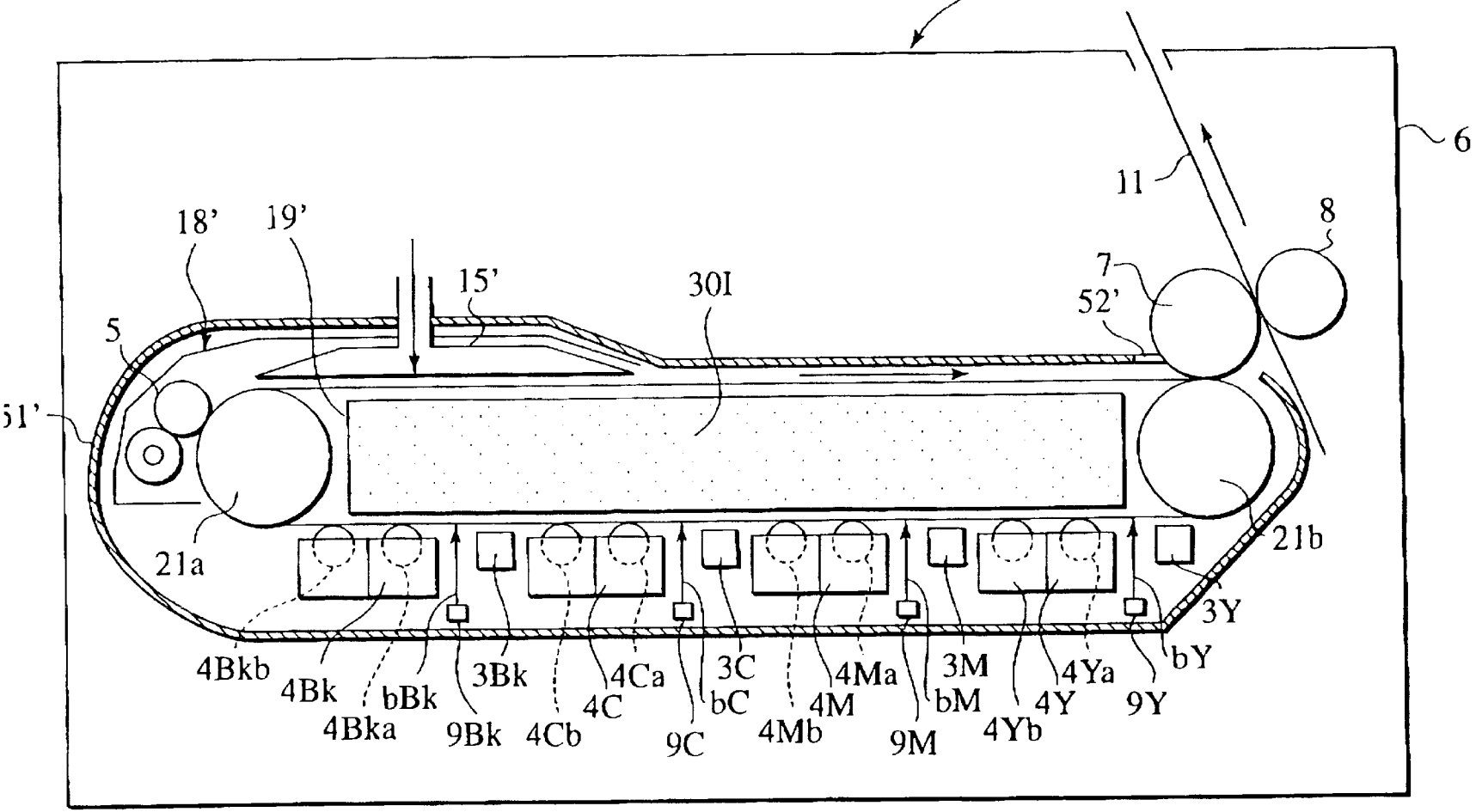
FIG. 13 is a schematic constitutional view showing the fourth embodiment of an electrophotographic printing apparatus of the present invention having a vessel for accommodating an image formation system.

FIG. 13 shows an example in which a vessel 51' for substantially accommodating an image formation system is applied to the electrophotographic printing apparatus 10 using the photosensitive body 2' in the form of a circulating belt shown in FIG. 9. The photosensitive body 2', the belt driving mechanism 21*a* and 21*b*, the developer units 4Y, 4M, 4C and 4Bk, the squeezes 4Yb, 4Mb, 4Cb and 4Bkb, the effluent solvent removing roller 5 and the blow nozzle 15' are sealed substantially in a space comparted by a vessel 51', and only a part of the intermediate transfer roller 7 that is used for transfer of a toner image to the print medium 11 is positioned outside of the vessel 51'. In this embodiment, a space between the intermediate transfer roller and the vessel 51' is provided at a position after transfer of an image and sealed by a sealing member 52', and a slight clearance is formed at a position before transfer. However, another construction is also permissible that the intermediate transfer roller 7 and press roller 8 are also accommodated in the vessel 51' and a part through which the recording medium 11 penetrates the vessel 51' is sealed.

A collection member 301 is placed In a space inside the photosensitive body 2', and a vaporized solvent generated in the vessel 51' is allowed to pass through the collection member 30I by a fan for generating an air flow (not shown), discharged out of the vessel 51', and reused in the blow nozzle 15' as air for drying. In accordance with this construction, an electrophotographic printing apparatus using a cartridge type image formation system which is compact can be obtained in such a manner that leaking of a carrier solvent out of the apparatus is small.

In a case of accommodating the image formation system in a vessel as exemplified in FIGS. 10 to 13, the fan which is used for passing the exhaust through the filter placed in a photosensitive body is possibly placed outside of the vessel. Therefore, by fixing this fan into the electrophotographic printing apparatus and by designing the image formation system and the vessel as a cartridge which is possibly attached to and detached from the apparatus, the sizes of the cartridge and the whole apparatus can be easily decreased and excellent carrying easiness of the cartridge is obtained.

Figure 14:
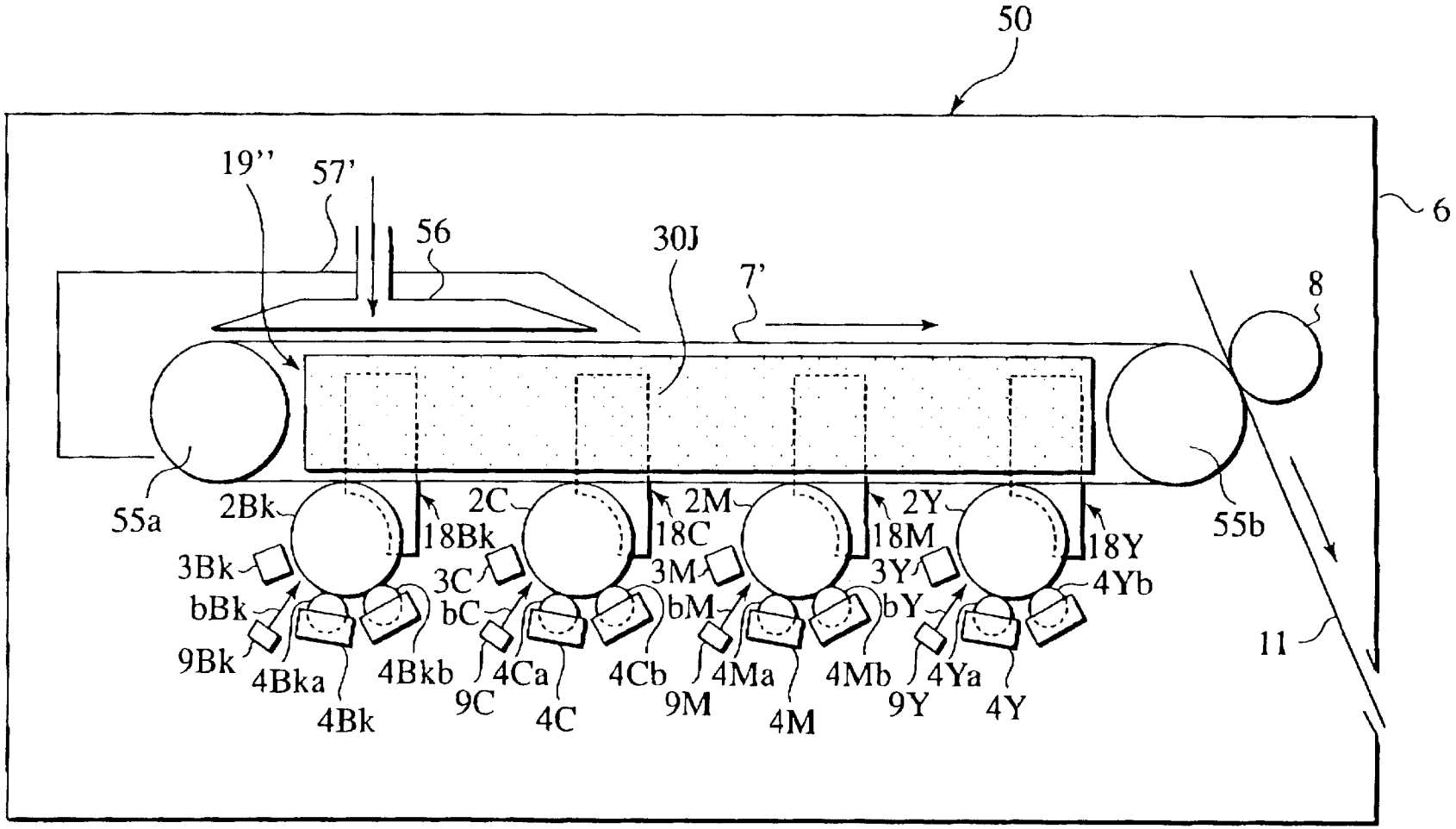
FIG. 14 is a schematic constitutional view showing another example utilizing the concept of a printing apparatus of the present invention.

FIG. 14 shows one example of an electrophotographic printing apparatus in which a full color image is formed on an intermediate transfer medium, using photosensitive bodies for forming a monochrome image in a number corresponding to the number of toner colors. In this apparatus 50, a yellow image, a magenta image, a cyan image and a black image formed on photosensitive bodies 2Y, 2M, 2C and 2Bk are transferred sequentially onto an intermediate transfer belt 7' which is circulated by a belt driving mechanisms 55*a* and 55*b*, and a full color image is consequently obtained and transferred onto a print medium 11. In this construction, since the photosensitive bodies 2Y, 2M, 2C and 2Bk are small, it is advantageous that the exhaust cleaning device 19" is placed in the inner space that is surrounded by the intermediate transfer belt 7'. Therefore, an exhaust containing a vapor of the carrier solvent vaporized from toner images formed on the photosensitive layers of the photosensitive bodies 2Y, 2M, 2C and 2Bk is fed to the exhaust cleaning device 19" fixedly supported inside the intermediate transfer belt 7' by means of air draft systems 18Y. 18M, 18C and 18Bk, and purified by a collection member 30J. In the air draft systems 18Y, 18M, 18C and 18Bk, drying mechanisms (not shown) using an effluent solvent removing roller and a blow nozzle are incorporated, respectively. As shown in the embodiment of FIG. 6, a plurality of collection members may also be provided. Full color images on the intermediate transfer belt 7' can be further dried using a blow member 56 as necessity arises, and the exhaust containing a solvent vapor produced from the intermediate transfer belt 7' is directed by a hood 57 to a collection member 30J. Transfer onto a print medium 11 can be improved by controlling the temperature of air fed from the blow member 56 so as to hear the toner images on the intermediate transfer belt 7'.

In the present invention, the whole apparatus can be constituted in compact size by constructing the inner space of the photosensitive body in which the collection member for removing a carrier vapor of a liquid developer generated in an image formation system is disposed. Moreover, since there is no excessive requirements to reduce the volume of the collection member, an apparatus having sufficient cleaning ability can be constituted. Moreover, in accordance the construction to fill the adsorbent in a particulate form as a cleaning device in a photosensitive body, the adsorbent moves by rotation force of the photosensitive body and the life span for adsorption of the carrier vapor can be elongated. Consequently, the size of the apparatus can also be effectively reduced. Still more, by accommodating the image formation systems in a vessel, those components of the apparatus can be easily constituted as a cartridge, and even when this cartridge is removed from the apparatus, diffusion of a solvent vapor from the photosensitive body can be suppressed. Change of the cartridge can also acts as change of the collection member.

This application claims benefit of priority under 35 U.S.C. §119 to Japanese Patent Application No. 2000-278491, filed on Sep. 13, 2000, the entire contents of which are incorporated by reference herein.

It must be understood that the invention is in no way limited to the above embodiments and that many changes may be brought about therein without departing from the scope of the invention as defined by the appended claims.

What is claimed is:

1. An electrophotographic printing apparatus for printing an image on a print medium with use of a liquid developer which contains a liquid carrier and a toner being dispersed in the liquid carrier, comprising:

an image printing system comprising a circulative imaging surface for forming a toner image from the liquid developer, and transferring the toner image from the circulative imaging surface to the print medium;

a collection member which is capable of absorbing or adsorbing vapor of the liquid carrier, the collection member being disposed in a place which is surrounded by the circulative imaging surface; and a vapor directing system which directs air containing the vapor of the liquid carrier vaporizing from the imaging surface to the collection member, the vapor directing system comprising a casing which substantially encloses the circulative imaging surface and holds the vapor of the liquid carrier in the casing to prevent the vapor from being leaked.

2. The electrophotographic printing apparatus of claim 1, wherein the image printing system comprises an evaporating device which evaporates the liquid carrier contained in the toner image on the circulative imaging surface to dry the toner image.

3. The electrophotographic printing apparatus of claim 2, wherein the evaporating device comprises a fan which directs air from the exterior of the casing to the toner image on the circulative imaging surface, and the vapor directing system comprises an exhaust which discharges air from the collection member to the exterior of the casing, whereby the air in the electrophotographic printing apparatus circulates among the exterior and the interior of the casing through the collection member.

4. The electrophotographic printing apparatus of claim 1, wherein the image printing system comprises a tubular photosensitive member on which a latent image corresponding to the image to be printed is generated, and the circulative imaging surface is on the circumference of the tubular photosensitive member.

5. The electrophotographic printing apparatus of claim 4, wherein the collection member comprises a cylindrical column which is coaxially disposed in the tubular photosensitive member, and the air containing the vapor of the liquid carrier and being directed by the vapor directing system pass through the collection member in the axial direction of the tubular photosensitive member.

6. The electrophotographic printing apparatus of claim 5, wherein the column has a radial partition which divides the inner space of the column into plurality of chambers.

7. The electrophotographic printing apparatus of claim 5, wherein the image printing system comprises an air nozzle which evaporates the liquid carrier contained in the toner image on the circulative imaging surface to produce a flow of the air containing vapor of the liquid carrier, and the vapor directing system comprises a guide cover which checks the flow of the air containing the vapor of the liquid carrier and guides the flow of the air to one axial end of the cylindrical column.

8. The electrophotographic printing apparatus of claim 1, wherein the image printing system comprises a circulative photosensitive belt on which a latent image corresponding to the image to be printed is generated, and the circulative imaging surface is on the circumference of the circulative photosensitive belt.

9. The electrophotographic printing apparatus of claim 1, wherein the collection member comprises a column containing a particulate material which is composed of an absorbent or an adsorbent.

10. The electrophotographic printing apparatus of claim 9, wherein the particulate material includes particles of charcoal.

11. The electrophotographic printing apparatus of claim 1, wherein the collection member has a porous filter comprising an absorbent or an adsorbent.

12. The electrophotographic printing apparatus of claim 1, wherein the vapor directing system comprises a fan which provides air flow to pass the air containing the vapor of the liquid carrier through the collection member.

13. An electrophotographic printing apparatus for printing an image on a print medium with use of a liquid developer which contains a liquid carrier and a toner being dispersed in the liquid carrier, comprising:

an image printing system comprising a circulative imaging surface for forming a toner image from the liquid developer, and transferring the toner image from the circulative imaging surface to the print medium, the image printing system comprising: a plurality of photosensitive drums on each of which a monochrome toner image of a different color is developed; and a circulative transfer belt on which the monochrome toner images developed on said plurality of photosensitive drums are joined to form the toner image to be printed, the circulative imaging surface including the circumference of the circulative transfer belt;

a collection member which is capable of absorbing or adsorbing vapor of the liquid carrier, the collection member being disposed in a place which is surrounded by the circulative transfer belt; and a vapor directing system which directs air containing the vapor of the liquid carrier vaporizing from the imaging surface to the collection member.

14. An electrophotographic printing apparatus for printing an image on a print medium with use of a liquid developer which contains a liquid carrier and a toner being dispersed in the liquid carrier, comprising:

an image printing system comprising a circulative imaging surface for forming a toner image from the liquid developer, and transferring the toner image from the circulative imaging surface to the print medium;

a collection member which is capable of absorbing or adsorbing vapor of the liquid carrier and disposed in a place which is surrounded by the circulative imaging surface, the collection member comprising a column containing a particulate material composed of an absorbent or an adsorbent with room for the particulate material to move in the column; and a vapor directing system which directs air containing the vapor of the liquid carrier vaporizing from the imaging surface to the collection member.

15. The electrophotographic printing apparatus of claim 14, wherein the column moves in cooperation with the circulative imaging surface, to cause move of the particulate material in the column.

16. The electrophotographic printing apparatus of claim 15, wherein the collection member further comprises a shock absorbing member for the move of the particulate material.

17. An electrophotographic printing apparatus for printing an image on a print medium with use of a liquid developer which contains a liquid carrier and a toner being dispersed in the liquid carrier, comprising:

an image printing system comprising a circulative imaging surface for forming a toner image from the liquid developer, and transferring the toner image from the circulative imaging surface to the print medium;

a collection member which is capable of absorbing or adsorbing vapor of the liquid carrier and disposed in a place which is surrounded by the circulative imaging surface, the collection member comprising: a column having a permeable partition which divides the inner space of the column into a plurality of chambers; and a treatment material which includes an absorbent or an adsorbent and which is charged in said plurality of chambers; and a vapor directing system which directs air containing the vapor of the liquid carrier vaporizing from the imaging surface to the collection member.

18. The electrophotographic printing apparatus of claim 17, wherein said plurality of chambers are aligned in a direction along which the air containing the vapor of the liquid carrier and being directed by the vapor directing system passes through the collection member.

19. The electrophotographic printing apparatus of claim 17, wherein the treatment material comprises the same number of material portions as said plurality of chambers, each of which is separately charged in each of said plurality of chambers, respectively, and said material portions have different strength of capability of absorption or adsorption.

* * * * *